US006505735B1

(12) United States Patent
Parker

(10) Patent No.: US 6,505,735 B1
(45) Date of Patent: Jan. 14, 2003

(54) LABEL FOR RESEALING A PACK OF SMOKING ARTICLES

(75) Inventor: Michael Patrick Parker, Leighton Buzzard (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 09/720,733

(22) PCT Filed: Jun. 24, 1999

(86) PCT No.: PCT/GB99/01983

§ 371 (c)(1),
(2), (4) Date: Feb. 12, 2001

(87) PCT Pub. No.: WO00/01594

PCT Pub. Date: Jan. 13, 2000

(30) Foreign Application Priority Data

Mar. 7, 1998 (GB) ..... 9814533

(51) Int. Cl.[7] ..... B65D 85/10

(52) U.S. Cl. ..... 206/268; 206/265; 206/274; 229/125.33

(58) Field of Search ..... 206/242, 265, 206/267, 268, 271, 273, 274; 220/359.1–359.3; 229/125.33–125.35; 383/211; 428/43

(56) References Cited

U.S. PATENT DOCUMENTS

| | | | | | |
|---|---|---|---|---|---|
| 3,630,346 | A | * | 12/1971 | Burnside | 206/532 |
| 4,673,601 | A | * | 6/1987 | Lamping | 229/125.35 |
| 4,902,142 | A | * | 2/1990 | Lammert et al. | 383/211 |
| 4,946,038 | A | * | 8/1990 | Eaton | 220/359.2 |
| 5,018,625 | A | | 5/1991 | Focke | |
| 5,096,113 | A | | 3/1992 | Focke | |
| 5,121,879 | A | | 6/1992 | Focke | |
| 5,299,833 | A | * | 4/1994 | Madole, Jr. | 428/43 |
| 5,476,698 | A | * | 12/1995 | Denny | 428/43 |
| 5,914,165 | A | * | 6/1999 | Freedman | 428/43 |

FOREIGN PATENT DOCUMENTS

| | | | |
|---|---|---|---|
| DE | 3447875 | A1 | 7/1986 |
| EP | 0661154 | A1 | 7/1995 |
| WO | WO 98/22367 | A1 | 5/1998 |

* cited by examiner

*Primary Examiner*—Jim Foster
(74) *Attorney, Agent, or Firm*—Jones Tullar & Cooper, P.C.

(57) ABSTRACT

A label (7) for resealing an enclosure of a cigarette pack is provided with a pull tab (10) defined by a cut (16) through one layer (14) of a two-layer structure (14, 15), the tab surface (19) being non-adhesive but at least part of the corresponding surface of the major portion of the label being permanently tacky (18).

15 Claims, 1 Drawing Sheet

LABEL FOR RESEALING A PACK OF SMOKING ARTICLES

BACKGROUND OF THE INVENTION

This invention relates to the packaging of smoking articles and is concerned with packs of smoking articles such as cigars, cigarillos or cigarettes (hereinafter referred to for convenience as "cigarettes").

In WO-A-98/22367 we have disclosed a resealable enclosure of a cigarette pack by virtue of the provision of a label or lamella with a continuous permanently tacky surrounding around and access opening (or potential access opening) of a barrier layer enclosure. The label/lamella is provided with a tab which can be grasped and pulled by a user to reveal the access opening. Similar tabs, on tear labels for packs for paper tissues, are seen in U.S. Pat. Nos. 5,018,625, 5,096,113 and 5,121,879.

SUMMARY OF THE INVENTION

We are concerned to provide in the present invention a lamella for a reasealable enclosure of a cigarette pack, and a cigarette pack having a resealable enclosure comprising a lamella.

A lamella according to the invention has two layers of material and a line of partial severance defining a boundary between a main portion of the lamella and a handling tab, the line of partial severance extending across the lamella through a first of the layers of material to leave the remaining layer(s) as a connective hinge between the main portion and the tab, a permanently tacky adhesive being applied to the exposed face of the main portion of the first layer. Preferably the partial severance is completely through the first layer but not into the other layer.

The line of partial severance provides a controlled line of weakness. It can also provide a positive folding action at the hinge. Preferably, the permanently tacky adhesive extends to and terminates at the line of partial severance to enhance the positive folding action. The surface of the tab will be free of adhesive to further enhance the folding action.

The following possible advantages are provided by the lamella according to the invention:

hinging of the tab at the correct position and angle, avoidance of tearing at the hinge, and controlled spring back of the tab after folding at the hinge.

A cigarette pack according to the invention has a resealable enclosure comprising the lamella of the invention, the main portion of the lamella covering an access opening of the enclosure and adhering by its permanently tacky adhesive to the surrounding of the access opening. The user can then grasp and pull the tab to uncover the access opening and reveal the cigarettes in the enclosure.

The user re-covers the access opening by returning the lamella to its initial position, the permanently tacky layer on the periphery of the inner face of the main portion re-adhering to the surrounding of the access opening.

The tab is preferably initially folded over to lie back against the main portion. Preferably, the access opening is within an outer cover of the pack. The pack may be any one of several types, such as a hinged-lid, slide-shell, soft or semi-rigid. In a hinged-lid pack, the lid of the pack lies against the tab and holds the tab folded back. In a slide-shell pack the shell lies against the tab to perform this function. In a soft or semi-rigid pack the tab is held folded over against a film outer layer or tax stamp. On opening the pack (of whichever type) the tab may then spring back to some degree, but still remains projecting of offer a finger hold.

The possibility of the tab being flush to the barrier enclosure is not excluded, but a user may then experience difficulty in grasping the tab. This difficulty could be particularly acute if the enclosure and the label were to have a plastic finish, as three might be a vacuum and/or static effect between tab and enclosure.

A further advantage of presenting the tab in an upturned, folded-back, position is that its function is evident to the user.

Optionally the tacky adhesive can extend to cover also the surface of the tab. Then, to prevent the tab from undesirably sticking to the enclosure or any other part of the cigarette pack, a mask is provided over the tacky adhesive of the tab. The mask may be formed from a layer of varnish.

Either or both of the first and second layers may be formed of plastics material such as polypropylene or polyester. Polypropylene is preferred for the first layer.

The upper surface of the second layer i.e. that which is to be outward in the pack may be printed upon and provided with an anti-scuff coating.

To produce a pack in which tab is provided in an upturned position when the pack is closed, the tab may be held folded back until the pack is closed to trap the tab in place. In a hinged-lid pack this would be by shutting the lid, in a slide-shell pack by sliding the enclosure into the shell, and in a soft or semi-rigid pack by wrapping the enclosure in film. For example the tab may be held folded back mechanically, or a short-term degradable adhesive may be provided on the upper surface of the tab to keep that tab turned up for as long as is necessary to complete the assembly of the pack. Subsequently the short-term adhesive degrades, and a user can open the pack and find the tab upturned but not adhering in that attitude to the main portion of the lamella. The tab will spring back to a certain extend when the pack is opened, but will still project in the manner indicated in FIG. 1.

BRIEF DESCRIPTION OF THE DRAWINGS

Particular embodiments of the invention will now be seen with reference to the accompanying drawings, wherein.

DETAILED DESCRIPTION OF THE PREFERRED EMBODIMENTS

Figure 1:
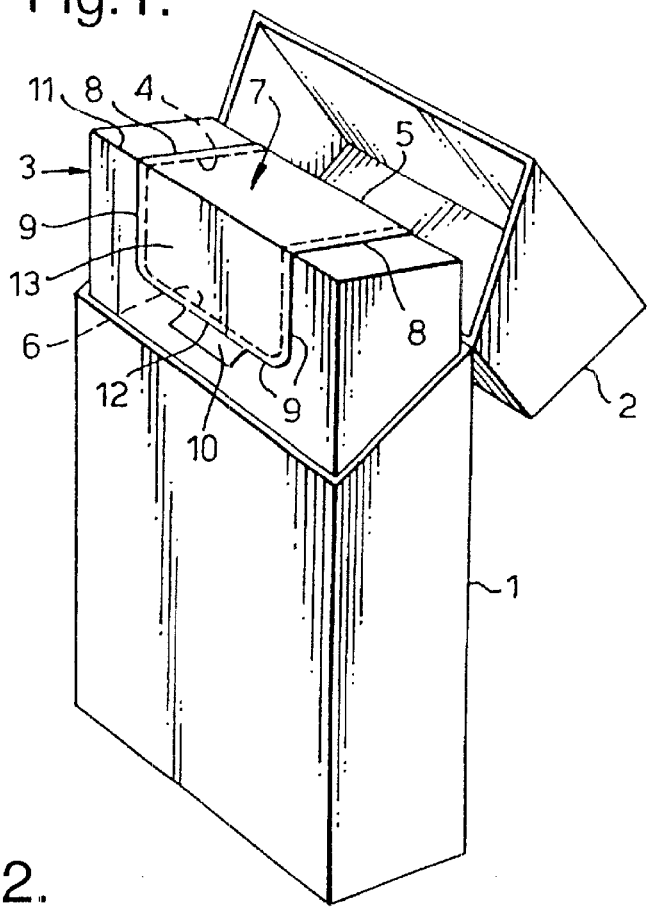
FIG. 1 is a perspective view of a cigarette pack embodying the invention.

FIG. 1 shows a cigarette pack with a rigid card pack 1 with a "flip-top" lid 2 containing a package 3 of cigarettes having a charge of cigarettes (not shown) inside a sealed enclosure formed by a barrier layer. The bounds of an aperture for allowing access to the cigarettes are indicated by parallel dotted lines 4 extending from the rearside of the package 3 where a hinge line is formed on the edge 5 across the top of the package and down the front as far as a third line 6 parallel to hinge 5. The barrier layer which encloses the charge may be make for example of metallized plastics or of a plastics/metal foil laminate. Over its aperture lies a lamella 7 in the form of a label, which has on its undersurface nearer to the barrier layer a permanently tacky adhesive.

The permanently tacky adhesive covers continuously the undersurface of a main portion 13 of the lamella. However, it may be applied to selected area only, but must be present where the lamella 7 extends at edges 8 and 9 beyond the openable edges of the aperture. A permanent bonding adhesive may be used on the portion of the undersurface which does not overlie the edges of the barrier layer.

Beyond one edge of the main portion 13 is a tab 10 hingeable about a hinge line 12 which is free of the permanently tacky material. The tab projects so that it may be grasped by the user and used to pull the label to open the package.

For the first use, the aperture edges 4 and 6 may have been defined by lines of weakening in the barrier material or by actual cuts to assist opening the aperture. The user is then free to remove cigarettes from the package through the aperture and after having done so may reseal the aperture simply by bringing down the tab so that the edge portions 8,9 re-adhere to the adjacent portions of the barrier layer material. The flap of barrier material formed by the separation along those lines when the tab 10 was lifted is returned to its previous position and although there will now be a line of separation in that barrier layer it is covered by the adhered edges 8,9 of the lamella.

To ensure as far as possible efficient adhesion an inner frame within the package offers a reaction surface underneath the barrier layer against the resealing pressure exerted on edges 8 and 9.

The package 3 may be a separate entity removable from the outer carton. The latter may be of any suitable type and in particular may be of the so-called "shell and slide" type wherein the package may be pressed from one end of the carton to protrude from the other for the purpose of exposing cigarettes for more ready access by the user.

Furthermore, the package above may be an independent entity, that is to say, may be sold without a rigid carton surrounding it, at least if, preferably, means such as a conventional clear celluloid overwrap were provided to provide further protection and prevent accidental disturbance of the tab 10. The resealable barrier layer may also be over a rigid carton.

Figure 2:
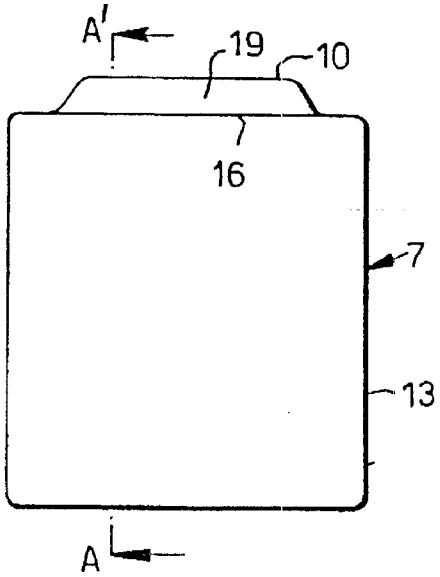
FIG. 2 is a face view of an embodiment of the lamella of the invention.

FIG. 2 shows a plan view of the undersurface of the lamella 7 which is completely covered with a layer 18 of permanently tacky adhesive. The tab 10 has been given a layer of varnish 19 to mask the adhesive on it.

Figure 3:
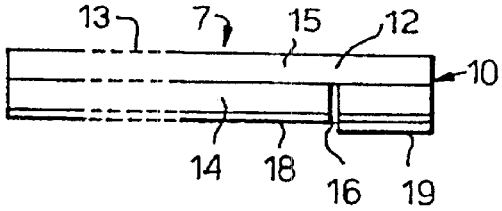
FIG. 3 is a schematic cross-sectional view of the lamella.

FIG. 3 is a schematic cross-sectional view of the lamella along the line AA' of FIG. 2. The lamella is in the form of a bilaminate with an inner layer 14 to lie next to the barrier layer of a pack and an outer layer 15 to be exposed. A severance line 16 has been cut through the thickness of the inner layer 14 only, to define the boundary between the main portion 13 of the lamella and the handling tab 10. The connective hinge line 12 in the outer layer is coincident with the severance line and allows the tab 10 to hinge outwardly.

Figure 4:
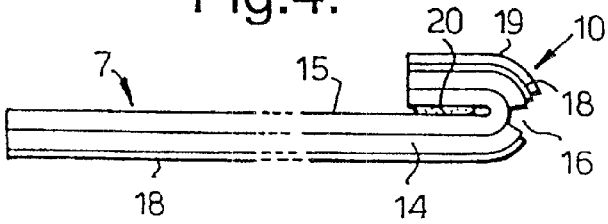
FIG. 4 is a cross-sectional showing the lamella with part folded back.

FIG. 4 shows the tab 10 folded back to overlie the main portion of the lamella. Temporary (degrading) adhesive 20 may hold, or assist holding, in that position. FIG. 4 also shows how permanently tacky adhesive layer 18, if present on the tab 10, is masked by varnish layer 19 or other covering.

An advantage of constructing the lamella as a bilaminate is that a cut can be made in the inner layer 14 to form the severance line 16 before the outer layer 15 is bonded to the inner layer. This requires much less control over the depth of cut than if the lamella were formed from a unitary layer.

A further advantage is that the inner 14 and outer 15 layers can be cut or stamped out of preadhesively coated sheet. The adhesive coating on the sheet of the inner layer 14 forms the permanently tacky adhesive on the inner face of the lamella, while the adhesive coating on the sheet of the outer layer 15 bonds the two layers together.

If the inner layer is cut or stamped out of a pre-coated sheet, any adhesive extending to the inner surface of the tab is preferably be neutralised. This is conveniently done by applying a layer of varnish to the adhesive on the tab. Alternatively the portion of the sheet which is to form the tab is left without permanently-tacky adhesive.

To produce a pack as in WO-A-98/22367 and in which the tab is provided in an upturned position when the pack is closed, the tab may be held folded back until the pack is closed to trap the tan in place. In a hinged-lid pack this would be by shutting the lid. The tab may be held folded back mechanically, or as described with reference to FIG. 4 a short-term degradable adhesive may be provided on the upper surface of the tab to keep the tab turned up for as long as is necessary to complete the assembly of the pack. Subsequently the short-term adhesive degrades, and a user can open the pack and find the tab upturned of the lamella. In a slide-shell pack the tab would be held mechanically by sliding the enclosure into the shell, and in a soft or semi-rigid pack by wrapping the enclosure in film. The tab will spring back to a certain extend when the pack is opened, but will still project in the manner indicated in FIG. 1.

What is claimed is:

1. A pack for smoking articles, said pack comprising:

a lamella as part of a resealable closure of an access aperture in the pack, said lamella having two layers, with a major portion of the lamella being separated from a minor portion by a cut through the thickness of a first of the layers, the major portion being at least over part of its surface permanently tacky for adhesion to an area of the pack adjacent to the aperture, with a corresponding surface of the minor portion not being permanently tacky, wherein the permanently tacky surface extends beyond the openable edges of the aperture and the minor portion acts as a lift tab for the closure.

2. A pack according to claim 1 wherein the lift tab is bent back over the major portion of the lamella when the pack is closed.

3. A pack according to claim 1 wherein the tab is temporarily adhered in a back-over position over the major portion of the lamella.

4. A pack according to claim 2 wherein the tab is temporarily adhered in a bent-back position over the major portion of the lamella.

5. A pack according to claim 3 wherein a short-term degradable adhesive is used to temporarily hold the tab in the bent-back position.

6. A pack according to claim 2 wherein the tab moves away from the major portion when the pack is opened.

7. A pack for smoking articles, said pack comprising:

a pack having an access opening; and a lamella covering the access opening and adhering by a permanently tacky adhesive to a surface of the pack adjacent to the access opening, said lamella including a major portion and a minor portion, and having two layers of material with a line of partial severance defining a boundary between the major portion and the minor portion of said lamella, wherein said permanently tack adhesive is located on at least part of the surface of said portion for adhesion of said major portion to the surface of the pack, while said minor portion is free of the permanently tacky adhesive.

8. A pack according to claim 7 in which the line of partial severance passes completely through a first of said layers, but does not extend into the second of said layers.

9. A pack according to claim 7 wherein the permanently tacky adhesive on the surface of the major portion extends to the line of partial severance.

10. A pack according to claim 7 in which the minor portion is positioned so as to act as a lift tab for the lamella.

11. A pack according to claim 10 wherein the lift tab is bent back over the major portion of the lamella when the pack is closed.

12. A pack according to claim 10 wherein the lift tab is temporarily adhered in a bent-back position over the major portion of the lamella.

13. A pack according to claim 11 wherein the lift tab is temporarily adhered in a bent-back position over the major portion of the lamella.

14. A pack according to claim 12 wherein a short-term degradable adhesive is used to temporarily hold the tab in the bent-back position.

15. A pack according to claim 11 wherein the tab moves away from the major portion when the pack is opened.

* * * * *

UNITED STATES PATENT AND TRADEMARK OFFICE

CERTIFICATE OF CORRECTION

PATENT NO. : 6,505,735 B1
DATED : January 14, 2003
INVENTOR(S) : Michael Patrick Parker It is certified that error appears in the above-identified patent and that said Letters Patent is hereby corrected as shown below:

Column 2,
Line 2, change “of” to -- to --.
Line 36, change “extend” to -- extent --.
Line 50, change “cross-sectional” to -- cross section --.
Line 64, change “make” to -- made --.

Column 4,
Line 14, change “tan” to -- tab --.
Line 21, add -- but not adhering in that attitude to the main portion -- between “upturned” and “of the lamella”
Line 25, change “extend” to -- extent --.
Line 49, change “back-over” to -- bent-over --.
Line 66, change “tack” to -- tacky --.
Line 67, change “said portion” to -- said major portion --.

Signed and Sealed this

Eighteenth Day of March, 2003

JAMES E. ROGAN
*Director of the United States Patent and Trademark Office*